US011679954B2

(12) United States Patent
Rodgers

(10) Patent No.: US 11,679,954 B2
(45) Date of Patent: Jun. 20, 2023

(54) RAPID ROPE

(71) Applicant: Christopher A. Rodgers, Albion, ID (US)

(72) Inventor: Christopher A. Rodgers, Albion, ID (US)

(73) Assignee: RAPID-ROPE LLC, Albion, ID (US)

( * ) Notice: Subject to any disclaimer, the term of this patent is extended or adjusted under 35 U.S.C. 154(b) by 0 days.

(21) Appl. No.: 17/712,901

(22) Filed: Apr. 4, 2022

(65) Prior Publication Data

US 2022/0227601 A1 Jul. 21, 2022

Related U.S. Application Data

(63) Continuation of application No. 16/806,316, filed on Mar. 2, 2020, which is a continuation of application No. 14/955,562, filed on Dec. 1, 2015, now Pat. No. 10,577,218.

(60) Provisional application No. 62/131,100, filed on Mar. 10, 2015.

(51) Int. Cl.

| | |
|---|---|
| ***B65H 75/32*** | (2006.01) |
| ***B65D 75/00*** | (2006.01) |
| ***B65D 43/02*** | (2006.01) |
| ***B65D 83/08*** | (2006.01) |
| ***B65H 75/16*** | (2006.01) |
| ***B65H 49/08*** | (2006.01) |
| ***B65D 85/675*** | (2006.01) |

(52) U.S. Cl.

CPC ..... *B65H 75/32* (2013.01); *B65D 43/0204* (2013.01); *B65D 43/0225* (2013.01); *B65D 75/002* (2013.01); *B65D 83/0841* (2013.01); *B65D 85/675* (2013.01); *B65H 49/08* (2013.01); *B65H 75/16* (2013.01); *B65D 2583/085* (2013.01); *B65H 2701/35* (2013.01)

(58) Field of Classification Search

CPC ..... B65D 83/0841; B65D 85/675; B65D 2583/085; B65D 85/04; B65H 49/08; B65H 75/16; B65H 2701/35

See application file for complete search history.

(56) References Cited

U.S. PATENT DOCUMENTS

| | | | | | |
|---|---|---|---|---|---|
| 1,158,159 | A | * | 10/1915 | Ball | B26B 27/00 30/290 |
| 1,981,388 | A | * | 11/1934 | Perry | A47F 13/045 225/80 |
| 2,086,016 | A | * | 7/1937 | Crandall | B43L 25/10 15/257.073 |
| 2,610,812 | A | * | 9/1952 | Epstein | B65D 85/04 116/281 |
| 3,071,299 | A | * | 1/1963 | Brown | A47F 13/045 30/127 |
| 3,351,974 | A | * | 11/1967 | Wilhelmi | E05B 85/08 411/72 |

(Continued)

*Primary Examiner* — Jonathan G Riley

(74) *Attorney, Agent, or Firm* — Eric B. Fugett; Mark A. Pitchford; Pitchford Fugett, PLLC

(57) ABSTRACT

A rope dispensing system for dispensing a continuous rope from a compressed rope cartridge. The device has a canister for storage of the rope cartridge, a resealable lid with a grommet for passing the rope through the lid, and a replaceable cutting mechanism for cutting the rope. Preferably the rope cartridge is shrink-wrapped to fit within case and keep rope from unraveling.

14 Claims, 18 Drawing Sheets

(56) References Cited

U.S. PATENT DOCUMENTS 3,836,059 A * 9/1974 Lauen ..... B65H 75/32 242/125.2
4,274,607 A * 6/1981 Priest ..... B65H 57/12 411/908
4,726,140 A * 2/1988 Mears ..... A01K 97/00 43/25
4,844,373 A * 7/1989 Fike, Sr. ..... B65H 49/322 242/596.4
5,172,841 A * 12/1992 Friedman ..... A47F 13/045 225/85
5,421,457 A * 6/1995 Listenberger ..... B65H 75/362 174/50
5,607,050 A * 3/1997 Dolan ..... A61C 15/043 206/408
10,577,218 B2 * 3/2020 Rodgers ..... B65H 75/32
2002/0190481 A1 * 12/2002 Casey ..... C09K 3/1028 277/602
2003/0226868 A1 * 12/2003 Monden ..... B65D 83/0841 225/39
2004/0001652 A1 * 1/2004 Robbiati ..... B31B 70/00 383/66
2004/0200332 A1 * 10/2004 Chen ..... B65H 54/71 83/648
2004/0222264 A1 * 11/2004 Tan ..... B65D 83/0805 225/106
2006/0144279 A1 * 7/2006 Bawabe ..... F42B 39/30 102/275.12
2008/0216327 A1 * 9/2008 Yarborough ..... B65H 49/08 30/273
2009/0072074 A1 * 3/2009 Tsai ..... B65H 75/32 242/602
2013/0092584 A1 * 4/2013 Sheehy ..... B65H 75/32 30/115
2013/0334241 A1 * 12/2013 Abdi ..... B65D 43/0204 220/837
2014/0061361 A1 * 3/2014 Marble ..... B65H 57/18 242/588.6
2014/0262866 A1 * 9/2014 Burrous ..... B25H 3/021 206/409
2015/0259051 A1 * 9/2015 Olshan ..... B63C 9/081 441/129
2016/0236857 A1 * 8/2016 Adams ..... B65D 47/06
2016/0332840 A1 * 11/2016 Seenarine ..... B65H 49/08

* cited by examiner

RAPID ROPE

PRIORITY/CROSS-REFERENCE TO RELATED APPLICATIONS

This application is a continuation of U.S. Nonprovisional application Ser. No. 16/806,316 filed Mar. 2, 2020, which is a continuation of U.S. Nonprovisional application Ser. No. 14/955,562 filed Dec. 1, 2015, which and issued as U.S. Pat. No. 10,577,218 on Mar. 3, 2020 and claims the benefit of U.S. Provisional Application No. 63/131,100, filed Mar. 10, 2015, the entire disclosures of each of which are hereby incorporated herein by reference.

BACKGROUND

Rope is used by a variety of users for a even larger variety of uses, including but not limited to domestic, backpacking, camping, hiking, boating, fishing, hunting, farming, ranching, gardening, work professions, etc. Historically, users of rope have had to use rope products that have consisted of hand coiled, spooled, or bundled of rope. The term rope used herein generally refers, according to Webster's dictionary, as being "a large stout cord of strands or fibers or wire twisted or braided together; a long slender strip of material used as a rope; or a row or string consisting of things united by or as if by braiding, twining, or threading. What is needed is a rope system for storing rope in a compact unit with simplified access to the rope and the ability to cut the rope into needed lengths.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a rope dispensing system that has a removable, replaceable rope cartridge. The system is referred herein as "Rapid-Rope" or the "Rapid-Rope System". The Rapid-Rope system is a uniquely designed novel multi-use rope dispenser system, including but not limited to domestic, light industrial and recreational uses.

The Rapid-Rope system holds and secures rope in a canister that can be dispensed at a desired length and then easily cut by the user. The user simply has to hold the canister containing the rope cartridge, pull the desired length of rope from the grommet dispenser, wrap the rope around the cutting insert, and pull to cut the rope. The canister can be easily stored, for example, in tool boxes, under a seat of a truck, or on a shelf in a work shop. It is anticipated that the Rapid-Rope system will be used with various types and lengths of rope, including Ultimate Tensile Strength (UTS) rope.

The Rapid-Rope system allows the user to avoid storage of conventional and/or available rope products and the difficulties that arise with use of such rope products, including, for example, tangling, knotting and unraveling.

As set forth above, the rope contained in (and dispensed from) the Rapid-Rope system is thought to be used for domestic or light industrial purposes, for example use by electricians, communications installers, electrical lineman, and any other profession that utilizes rope in their work or for any task around the house that requires rope. Examples of recreational uses include hunting, fishing, boating, camping, hiking, and backpacking.

The Rapid-Rope system is a very durable simple product to use and store. The Rapid-Rope system is expected to be provided to a consumer with the cartridge of rope pre-loaded and ready to use upon purchase. The user will simply remove the minimal packaging, pull the rope tip exposed at the opening of the rubber grommet (described below), pull the desired length of rope, and wrap that portion of the rope to be cut around the cutting insert. In a preferred embodiment, as the cartridge of rope is depleted, the user can purchase a Rapid-Rope replacement rope cartridge and load it in the canister. In this embodiment, there will also offer a replacement Rapid-Rope rubber grommet and a replacement Rapid-Rope cutting insert. Alternatively, in a second embodiment the canister itself can be made as a disposable canister, such that when a user has exhausted the supply of rope the user discards the canister.

Further, in a preferred embodiment the rope cartridge is formed by winding the rope in a precision winder. The rope is wound tightly such that the ends of the rope overlap such that the ends will not unravel or fall away from the cartridge, and thus do not cause unwinding of the cartridge without outside force. In a preferred embodiment the rope is wound using the process of precision coreless winding. The rope is wound into a cartridge of size to fit within a preselected canister. It is thought that in a preferred embodiment that the rope will be wound into a cartridge such that the rope fits tightly into the pre-selected canister. After winding, the cartridge is shrink-wrapped with plastic to maintain its size and shape. In a preferred embodiment, the precision coreless wound rope is dispensed from the center of the cartridge. After a cartridge of rope is exhausted, the user discards the leftover plastic shrink wrap and installs a new cartridge into the canister.

What is disclosed is a rope dispensing system for dispensing a continuous rope from a compressed, coreless rope cartridge. The dispensing system has a canister and a coreless, wound rope cartridge for dispensing from the canister. The canister generally is of a cylindrical shape, although square box shapes or rectangular box shapes could also be utilized The canister in a preferred embodiment has a closed end and an open end and defines an interior space for receiving the coreless rope cartridge. The canister has a releasable or openable lid configured to close the open end when the lid is closed. The canister has an opening for passage of the rope in a single length through the opening. In a preferred embodiment the opening is located in the lid of the canister. In a preferred embodiment the opening has a grommet positioned in the opening configured to prevent rope that has passed through the opening from retracting back into the canister. In a preferred embodiment the canister has a replaceable cutting mechanism positioned on the exterior of the canister and used for cutting the rope that has been dispensed from said canister.

The canister lid can be made in a variety of embodiments, including but not limited to a snap-on lid or a threaded lid that engages with threads located on the canister. In a preferred embodiment the replaceable cutting mechanism is attached to the lid. In a further preferred embodiment the replaceable cutting mechanism is an insert having a cutting blade and is attached as a removable section of the lid. In this way the cutting mechanism can be replaced if it becomes damaged or dulled from use. In a preferred embodiment, the replaceable cutting mechanism can be configured to slide into groves in the lid to lock into place or it can snap onto the lid.

In a preferred embodiment the replaceable cutting mechanism is made up of a blade guard having a generally U-shaped opening in which one of the arms of the blade guard attaches to the lid. A blade is fixedly positioned within said U-shaped blade guard to provide a cutting surface for the rope while the blade guard protects a user's hands (or other objects that come into contact with the rope dispensing system).

The rope that is dispensed from the system typically includes nylon rope, hemp rope, polypropylene rope, and polyester rope. This includes, for example 11001b UTS ropes.

Several methods of utilizing a rope dispensing system are also disclosed. These methods include, for example, a method of using a rope dispensing system, having a step of providing a canister containing a coreless rope cartridge to a user. The canister has a generally cylindrical shape defining a hollow interior and comprising a closed bottom and an openable top. The coreless rope cartridge is in generally a cylindrical shape configured for being positioned within the interior of the canister, although the rope cartridge can be provided in whatever shape fits into the canister. The coreless rope cartridge has a shrink wrapped cover or coating. The canister has an opening configured for the passage of a first end of a rope wound into the coreless rope cartridge such that the rope can be pulled as a length from the cartridge. In a preferred embodiment the opening has a grommet configured to allow passage of the rope out of the cartridge. The rope canister has a replaceable cutting mechanism positioned on an exterior of the canister and configured for cutting of said rope.

The method of using the rope dispenser includes the step of dispensing the rope wound onto said coreless rope cartridge by placing a first end of the rope through the opening in the cartridge, closing the lid of the canister, pulling said rope out of the canister by pulling the rope through the opening.

In a preferred embodiment the method of dispensing rope includes the step of cutting dispensed rope with the replaceable cutting mechanism in order to provide a section of rope at the user's desired length.

In a preferred embodiment the method of using a rope dispensing system includes the step of replacing the rope cartridge in the canister. The step of replacing the rope cartridge in the canister opening said lid on said canister, removing said shrink wrap cover and any remaining rope, placing a cylindrical shrink wrapped rope cartridge comprising a length of rope having a first end and a second end into said canister, placing said first end of said length of rope through said grommet, and closing the lid of the canister.

In a preferred embodiment one of the disclosed methods includes the step of replacing the replaceable cutting mechanism. In an embodiment the replaceable cutting mechanism is in a U-shape. A first section of the U-shape being a first arm of the U of the shape is configured for interlocking placement in an opening in the lid. The U-shaped cutting mechanism has a cutting blade positioned between the arms of said "U" shape. In this configuration the second arm of said "U" shape is a blade guard.

In a preferred embodiment, the method of using a rope dispensing system includes a step of cutting rope that has been pulled through the opening from the canister. This step includes positioning a length of rope into said U shaped replaceable cutting mechanism. The rope is positioned generally perpendicular to the U shaped replaceable cutting mechanism and the user forces the rope onto or across the cutting blade to cut the rope.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE PREFERRED EMBODIMENTS

Figure 1:
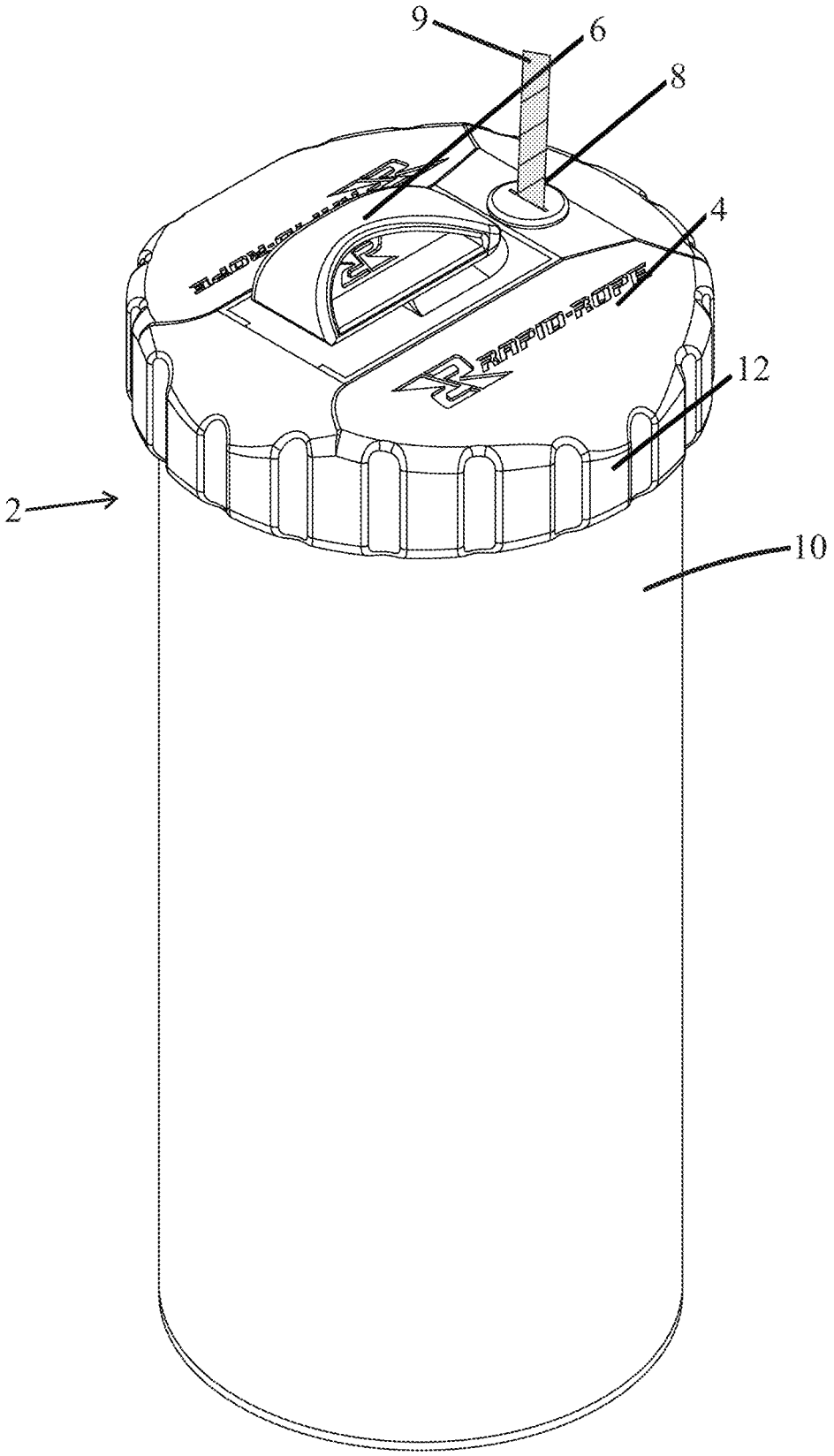
FIG. 1 is a perspective view of the disclosed Rapid-Rope system.

The components listed in this section correlate to the drawings submitted concurrently with this application, and are illustrative of the inventive concept(s) disclosed herein. It is thought that additional features and components can be included or substituted without departing from the spirit of the invention.

Shown in the figures is an embodiment of the disclosed rope dispensing system 2. The lid 4 fastens to the canister 10. The rubber grommet 8 and the cutting insert 6 are located in the lid such that the grommet provides a pass through point for the rope 9. In a preferred embodiment, the lid forms the top of the assembly including the rubber grommet and cutting insert.

In a preferred embodiment, the lid is fastened to the canister with a snap fit system or is attached via threaded engagement to the canister 18. In the snap-fit system lid is snapped onto the canister and it is secured. Alternative mechanisms can be used to attach the lid to the canister.

Figure 8:
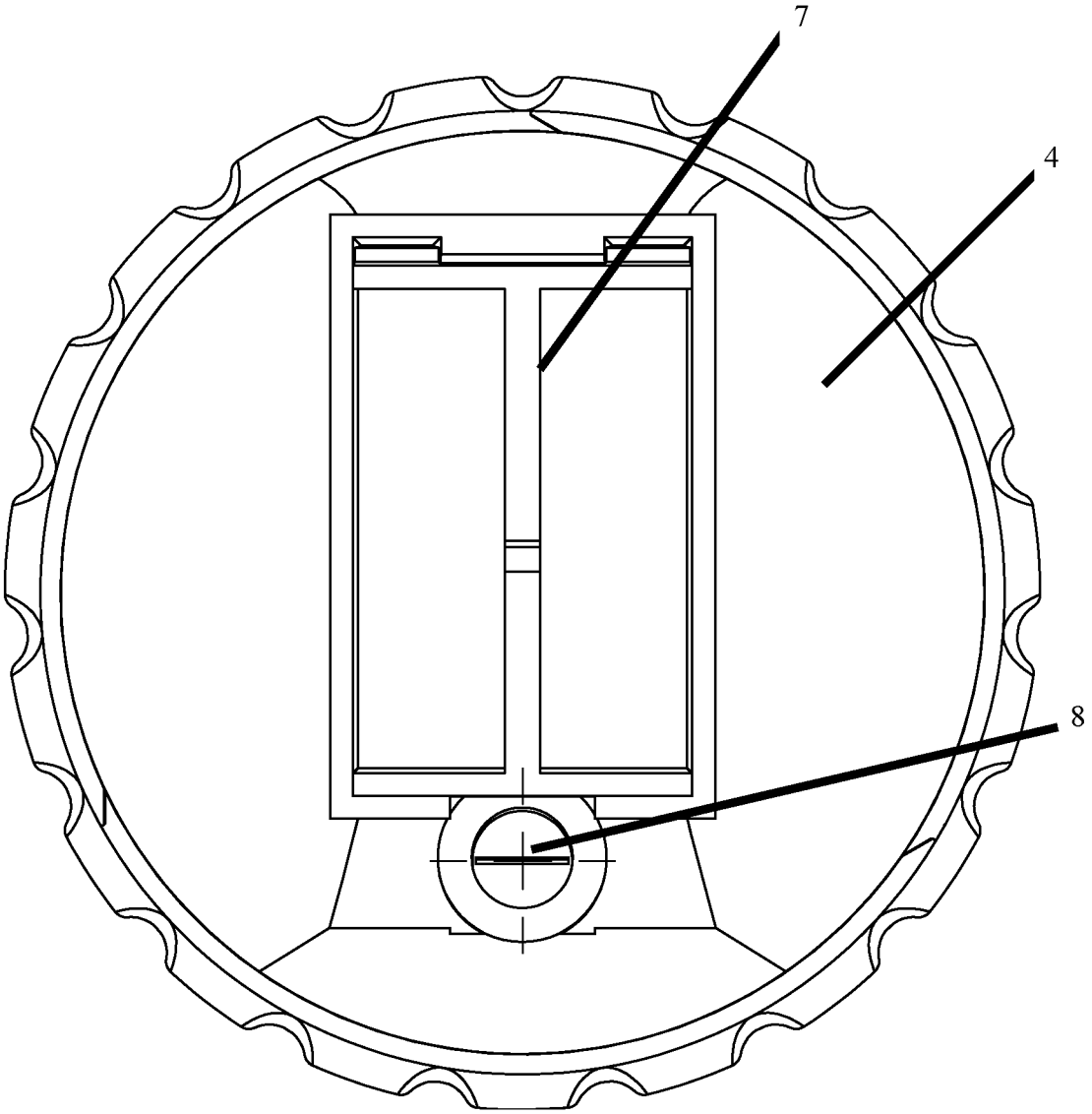
FIG. 8 is a bottom view of the lid for the disclosed Rapid-Rope system with the cutting insert installed.
Figure 9:
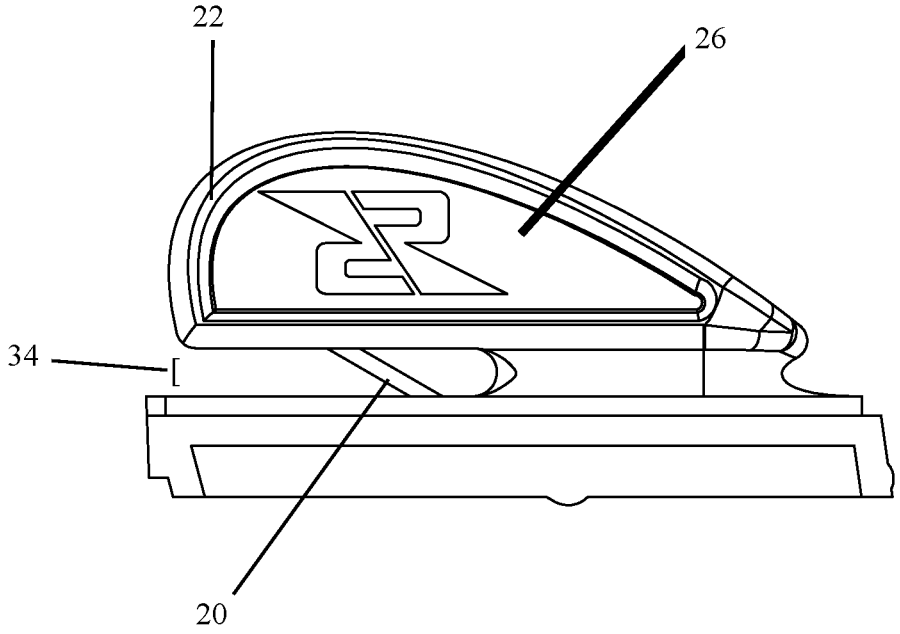
FIG. 9 is a side view of the cutting insert for the disclosed Rapid-Rope system.
Figure 10:
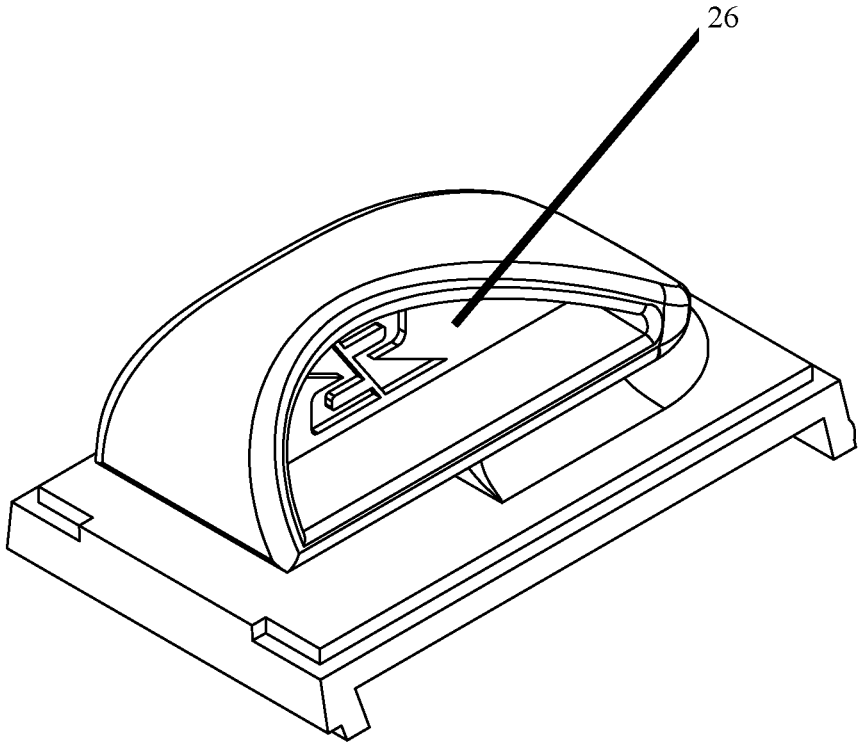
FIG. 10 is a perspective view of the cutting insert for the disclosed Rapid-Rope system.
Figure 22:
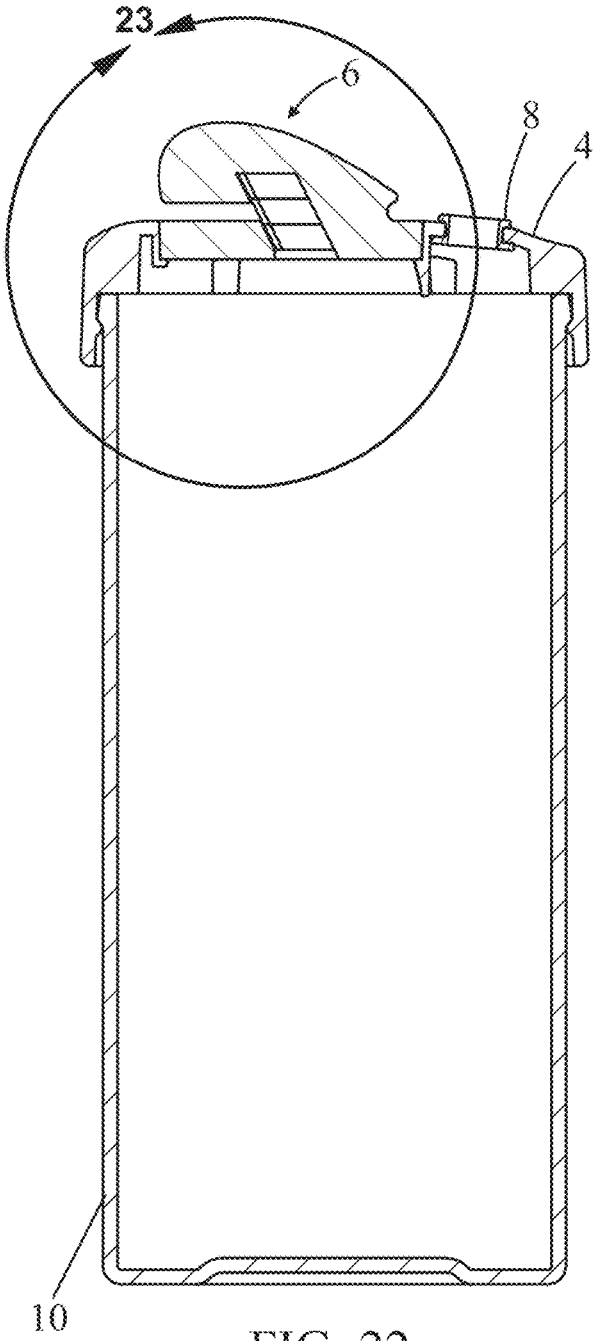
FIG. 22 is a sectional view of the Rapid-Rope system of FIG. 21 taken along line 22-22 of FIG. 20.
Figure 23:
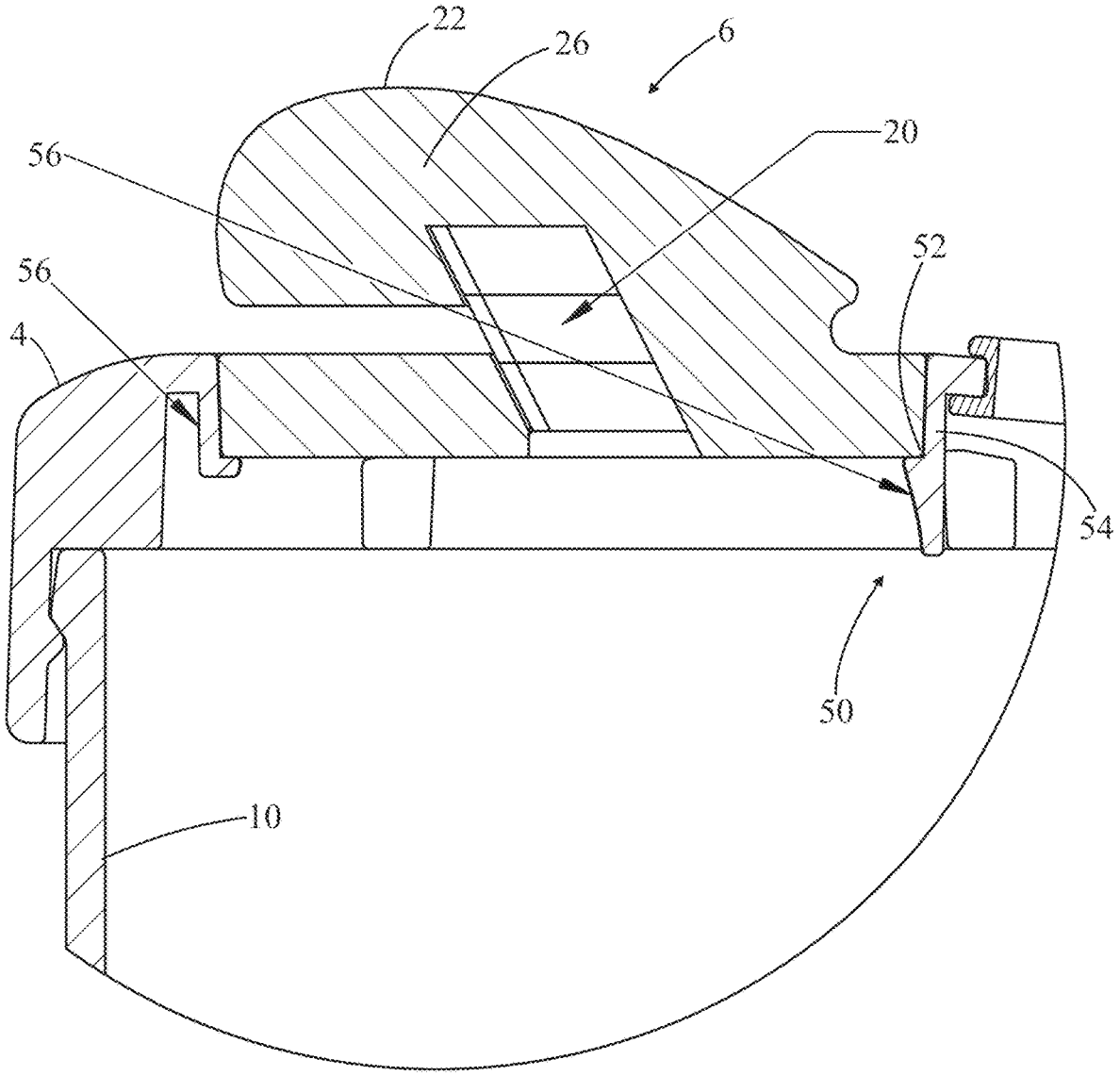
FIG. 23 is an enlarged detail view of the Rapid-Rope system of FIG. 21 at location 23 of FIG. 22.

In a preferred embodiment the cutting insert 6 has a bumper portion 22 and tab portion 26 that provides for protection of a user's fingers or other exterior object from the blade 20. The bumper portion and tab form a leg of the cutting insert provided in a u-shape. The cutting blade 20 is positioned in the valley of the U shape with width depicted by space 34 such that material outside of the u-shape is protected from the blade. In a preferred embodiment the cutting insert fits into an opening 36 in the lid. The cutting insert in a preferred embodiment is removable attached to the lid such that the cutting insert covers or closes the opening 36 while forming a unitary (1 piece) lid when attached. A hook 50 at the opening 36 of the lid engages an edge 52 of the cutting insert 6 to retain the cutting insert 6 in the opening 36 of the lid. The hook 50 includes a stem 54 and a head 56. The stem 54 extends downwardly from the lid. The head 56 protrudes outwardly from the stem 54. The head 56 engages the edge 52 of the cutting insert 6. FIGS. 8, 22, and 23 depict views of the cutting insert 6 attached to the lid.

In a preferred embodiment, the lid is composed of plastic and manufactured by processes including, but not limited, to injection molding or blow molding. The lid can include a hand grip 12 for a user to grasp when removing the lid. The lid can be composed of a variety of materials that do not depart from the spirit of the invention.

In a preferred embodiment, the cut insert is a molded one-piece replaceable part. In the preferred embodiment, the cutting insert comprises a carbon steel blade over-molded inside the cut insert to insure an exact fit in every production. The carbon steel blade is protected by an over-mold, with a small opening, making the blade less accessible and the rope dispensing system safer for use. The length and width of the blade can vary based on the size, shape, and/or UTS of the rope contained in any given Rapid-Rope system product.

The cut insert can be made to be replaceable in a preferred embodiment. In this embodiment, an insert replacement part can be simply snapped into place after the original insert is removed. If the cut insert becomes dull due to use, the Rapid-Rope cut insert replacement can be easily installed.

Figure 11:
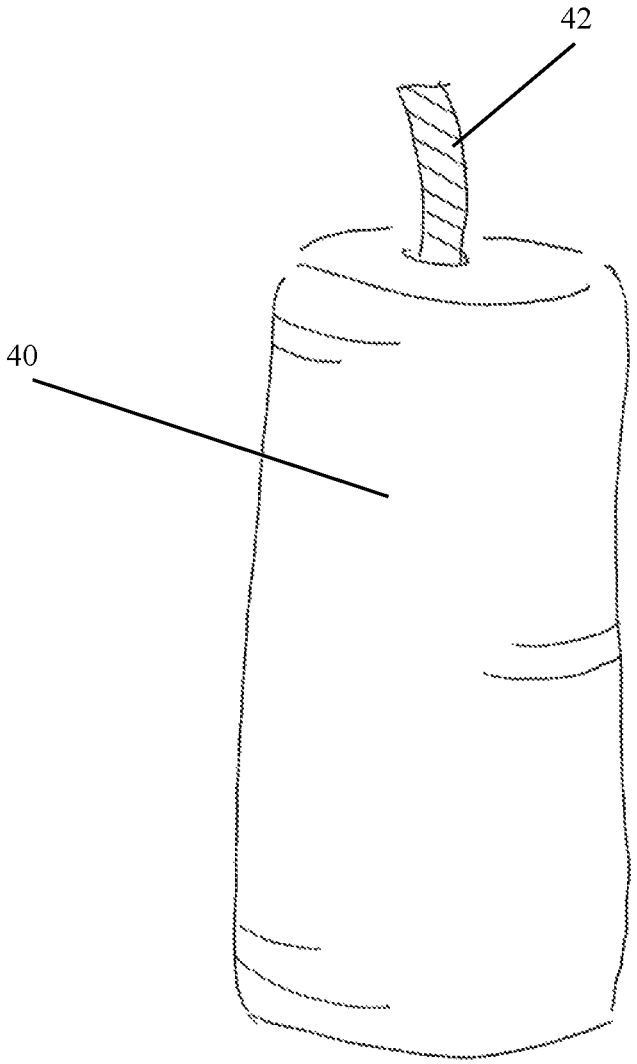
FIG. 11 is a perspective view of a shrink-wrapped rope cartridge for the disclosed Rapid-Rope system.
Figure 12:
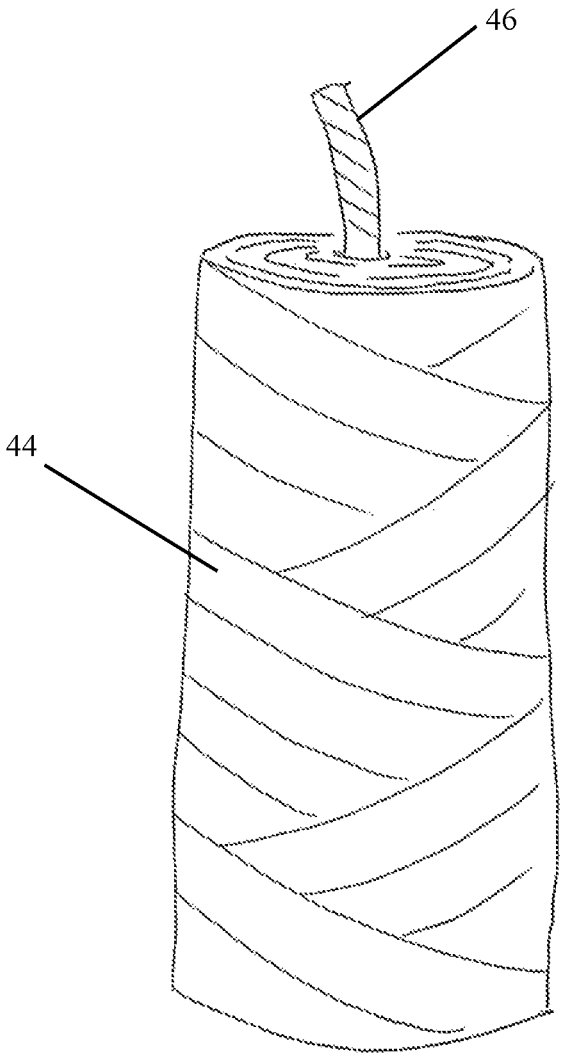
FIG. 12 is a perspective view of the compressed rope cartridge for the disclosed Rapid-Rope system.
Figure 13:
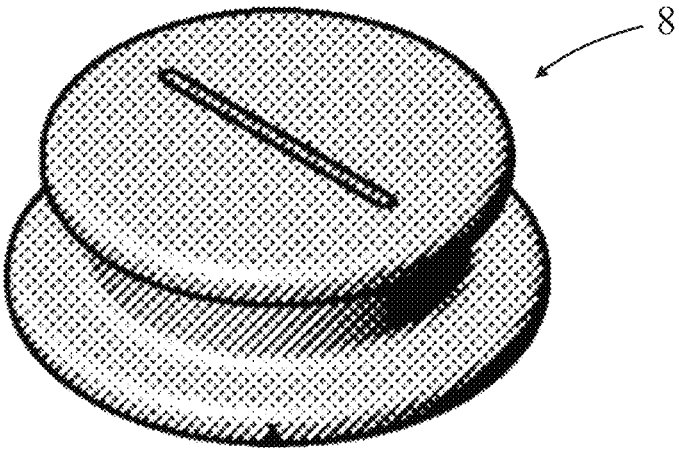
FIG. 13 is a perspective view of the grommet for the disclosed Rapid-Rope system.
Figure 14:
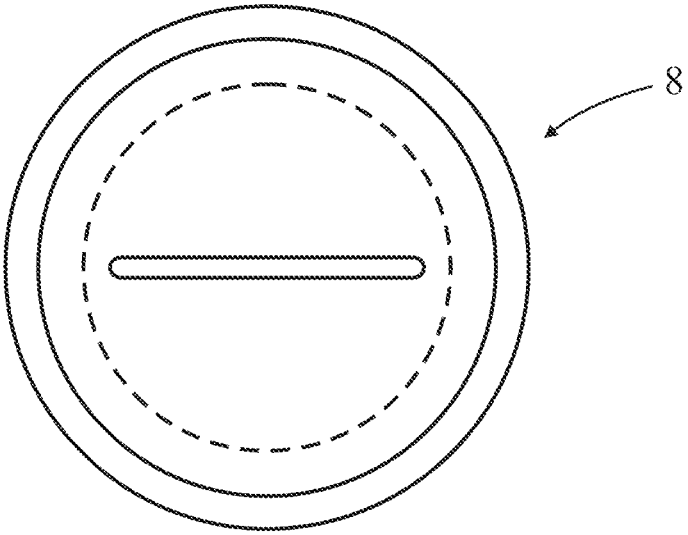
FIG. 14 is a top view of the grommet of FIG. 13.
Figure 15:
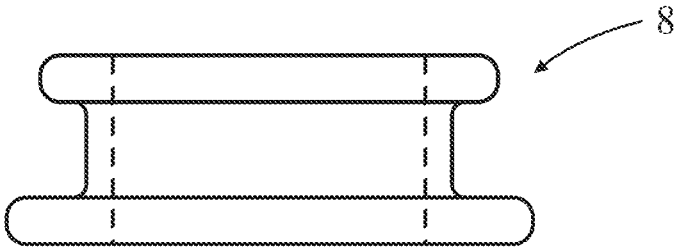
FIG. 15 is a side view of the grommet of FIG. 13.
Figure 16:
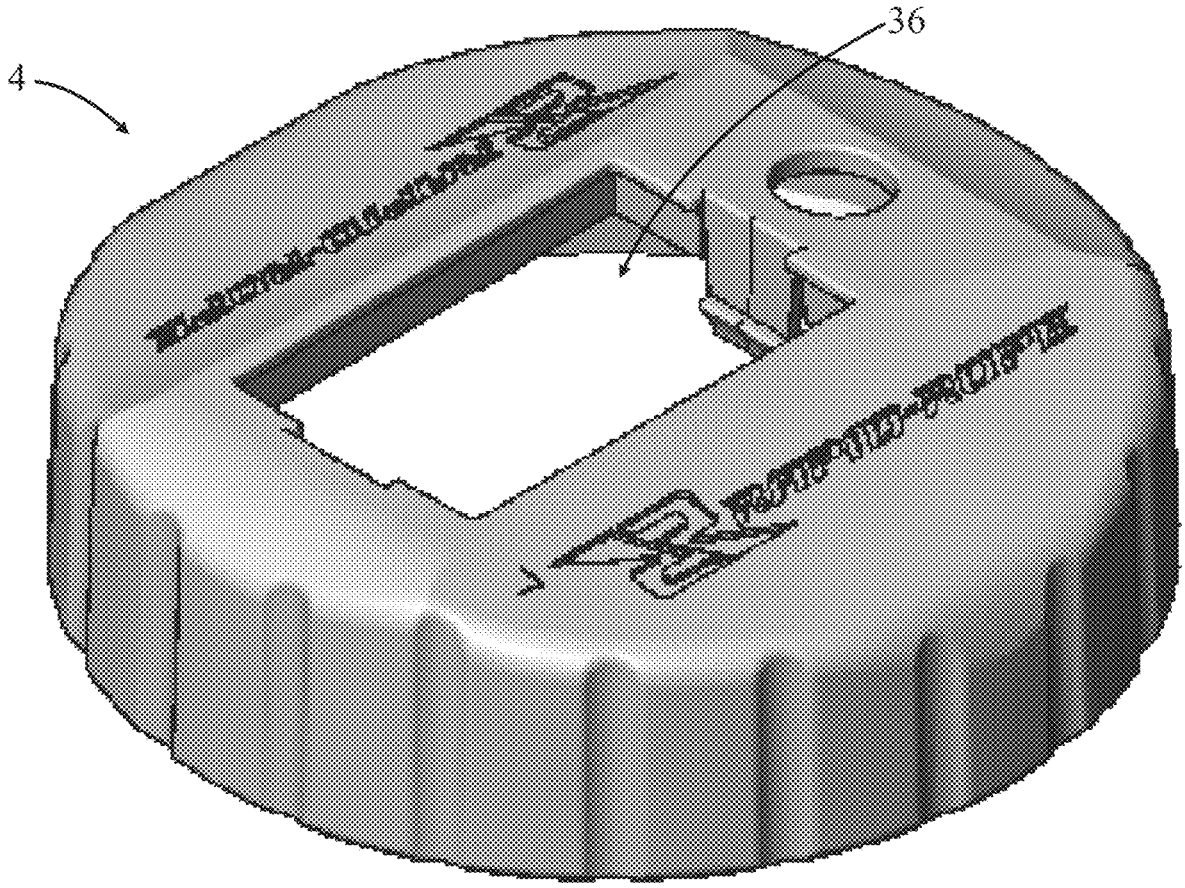
FIG. 16 is a perspective view of a lid for the disclosed Rapid-Rope system with the cutting insert and grommet removed.
Figure 17:
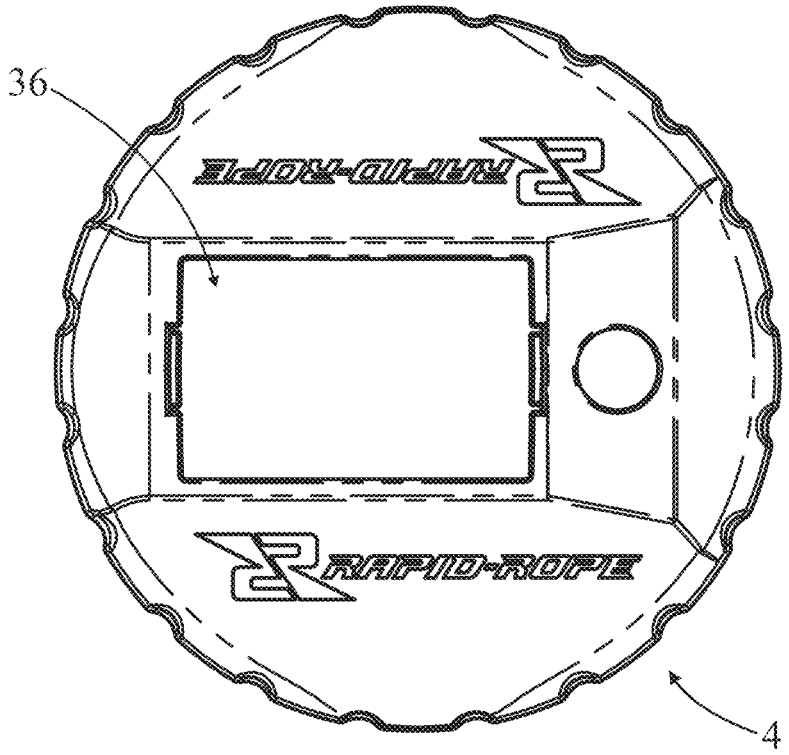
FIG. 17 is a top view of the lid of FIG. 16.
Figure 18:
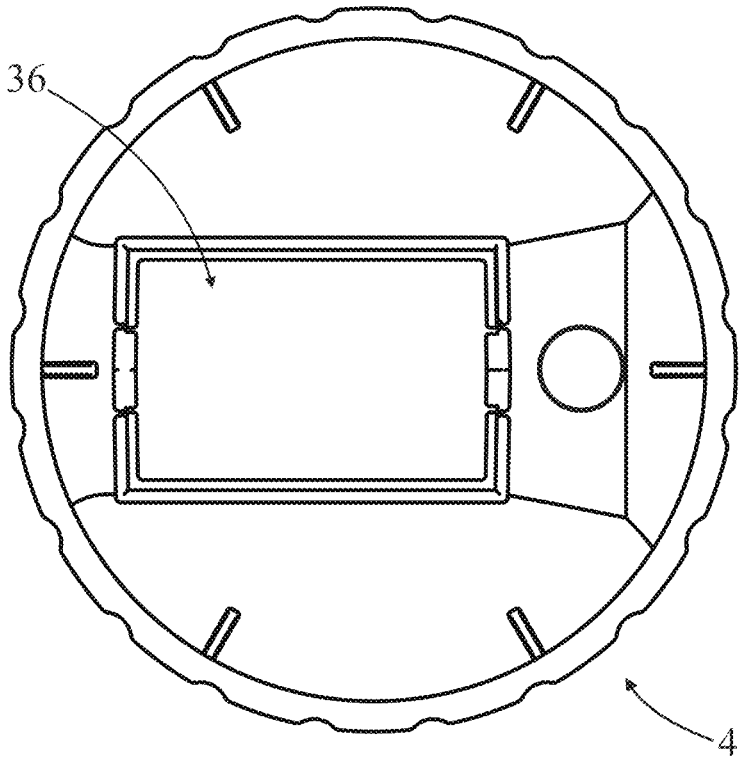
FIG. 18 is a bottom view of the lid of FIG. 16.
Figure 19:
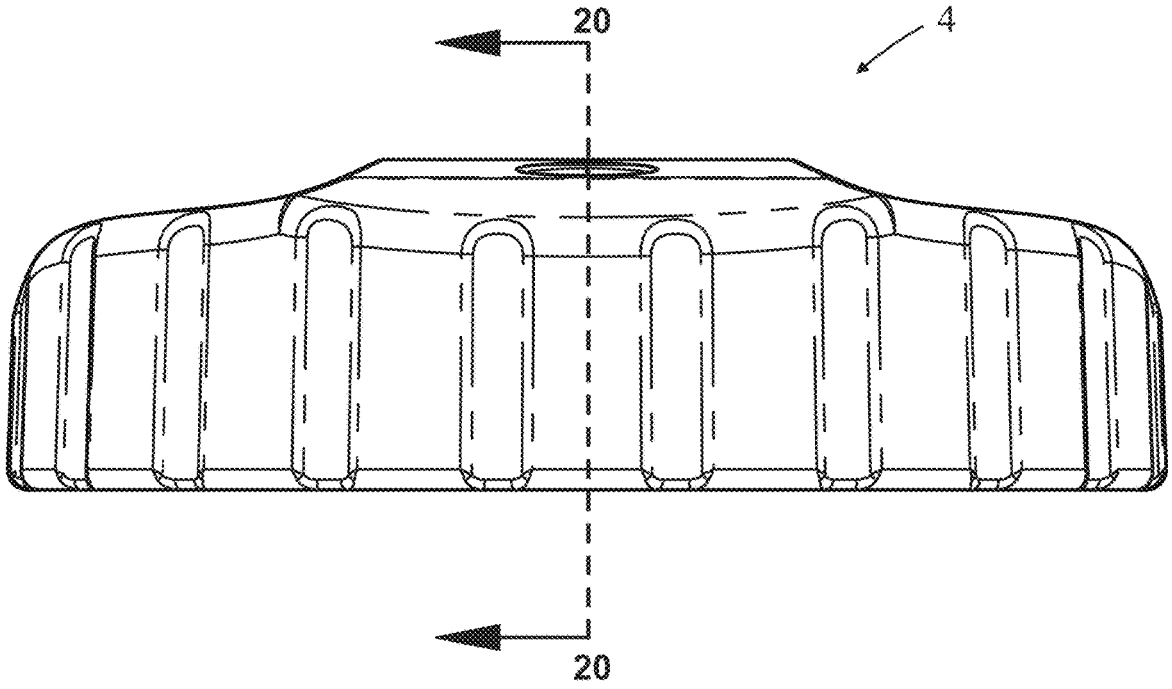
FIG. 19 is a side view of the lid of FIG. 16.
Figure 20:
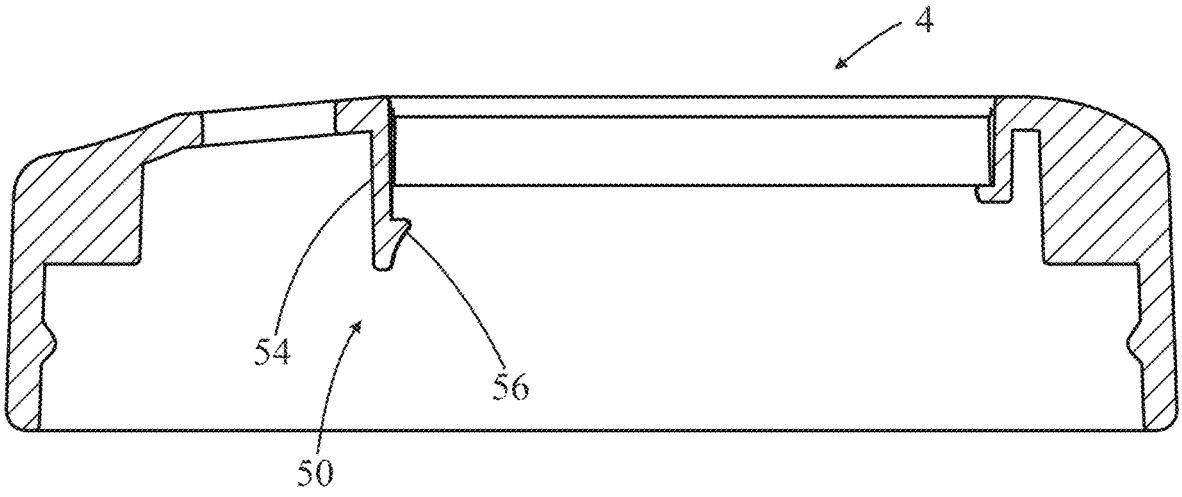
FIG. 20 is a sectional view of the lid taken along line 20-20 of FIG. 19.
Figure 21:
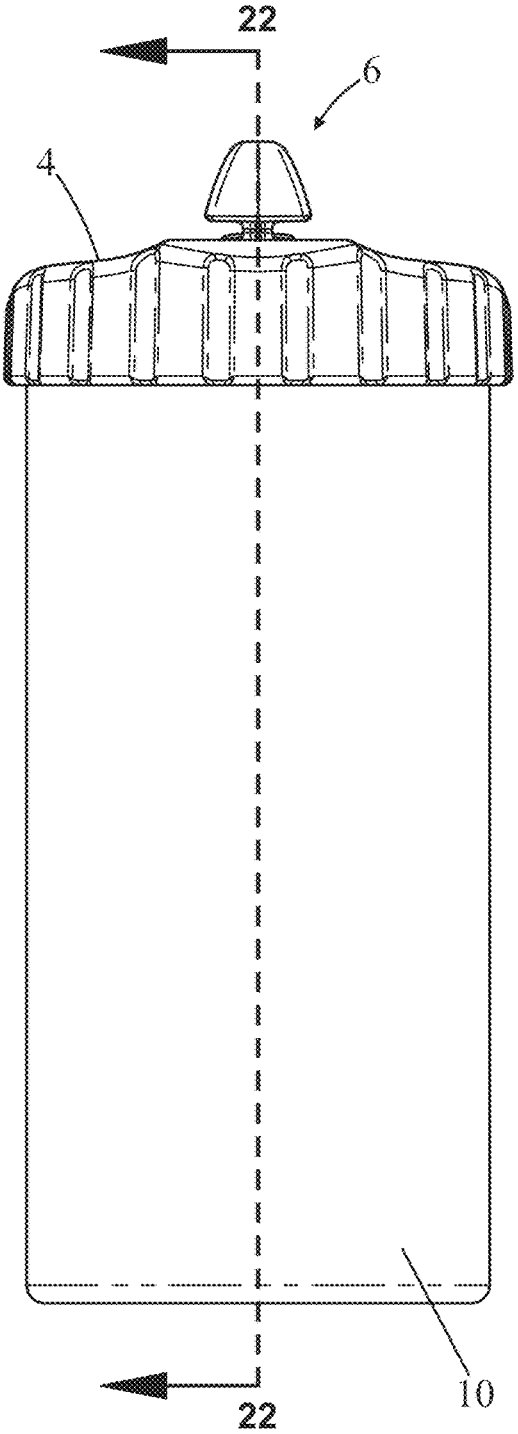
FIG. 21 is a side view of an embodiment of the disclosed Rapid-Rope system with the cutting insert and grommet installed in the lid of FIG. 16.

FIGS. 11 and 12 depict embodiments of the replaceable rope cartridge. In a preferred embodiment the rope 42 is wound into a coreless rope cartridge and then shrink wrapped. FIG. 11 depicts the rope 42 wound into a coreless cartridge and encapsulated by shrink-wrapping 40. FIG. 12 depicts the coreless rope cartridge 44 without shrink wrapping and with an end of the rope protruding from the cartridge and ready to be pulled to be unwound from the cartridge, and thus dispensed.

The following is a description of how the cut insert is removed and how the Rapid-Rope cut insert replacement is installed in a preferred embodiment:

1. Grasp the canister in hand and unsnap the lid.
2. Place the lid on flat surface.
3. Place fingers on the cut insert closest to the grommet.
4. Release the catch and push down firmly on the cut insert closest to the grommet.
5. Discard "old" cut insert.
6. Slide new Rapid-Rope cut insert into place from inside of lid at the same location the "old" cut insert was removed from.
7. Push the new Rapid-Rope cut insert in an upward direction until it clicks into place.
8. Place the lid onto the canister and snap in place.
9. Ready for use.

The grommet is located on the top of the lid and is designed to create resistance (or "hold") on the rope being pulled and/or dispensed from the canister, so that it can be easily cut with the cut insert. The grommet in the depicted embodiment also aids in the container being water resistant.

The grommet in a preferred embodiment will be made of rubber material and will be manufactured by processes including but not limited to injection molding or blow molding.

The grommet in a preferred embodiment is a rubber ring is inserted into a hole through the lid, and is collared on all sides to keep the grommet in place.

In a preferred embodiment, the grommet is made to be replaceable. When and if the grommet becomes warn or damaged due to use, a grommet replacement can be easily installed.

The following is a description of how the grommet is removed and how the Rapid-Rope rubber grommet replacement is installed:

1. Unsnap lid from the canister.
2. Place the lid on flat surface and push the grommet in a downward direction until it is comes out of the collar inside the lid.
3. Discard the "old" grommet.
4. Install new Rapid-Rope rubber grommet by pushing into place from inside of the lid and into the molded collar until secure.
5. Make sure the flat side of Rapid-Rope rubber grommet replacement is facing the cut insert.
6. Place the lid onto the canister and snap in place.
7. Ready for use.

Figure 2:
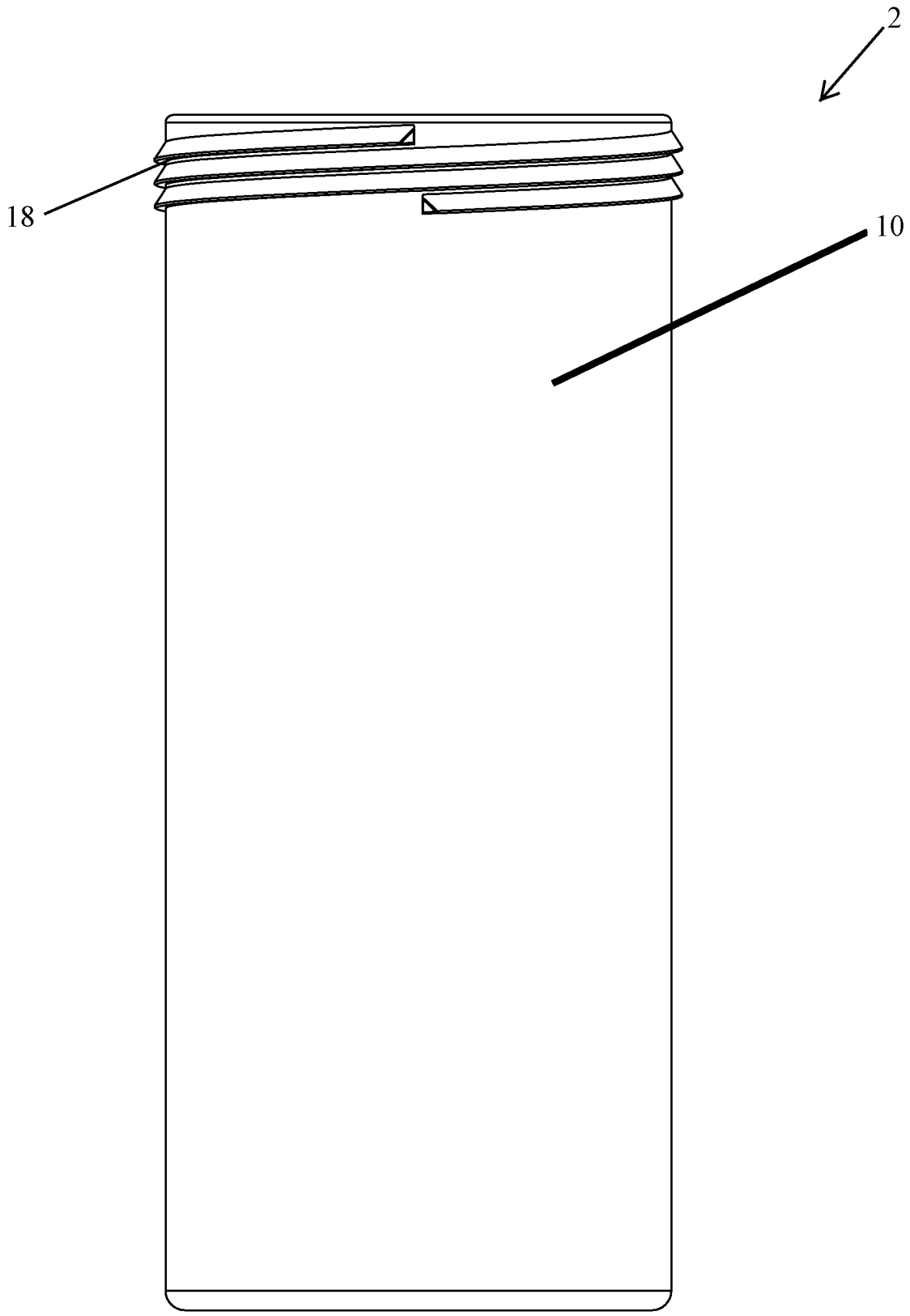
FIG. 2 is a perspective view of the canister for the disclosed Rapid-Rope system.
Figure 3:
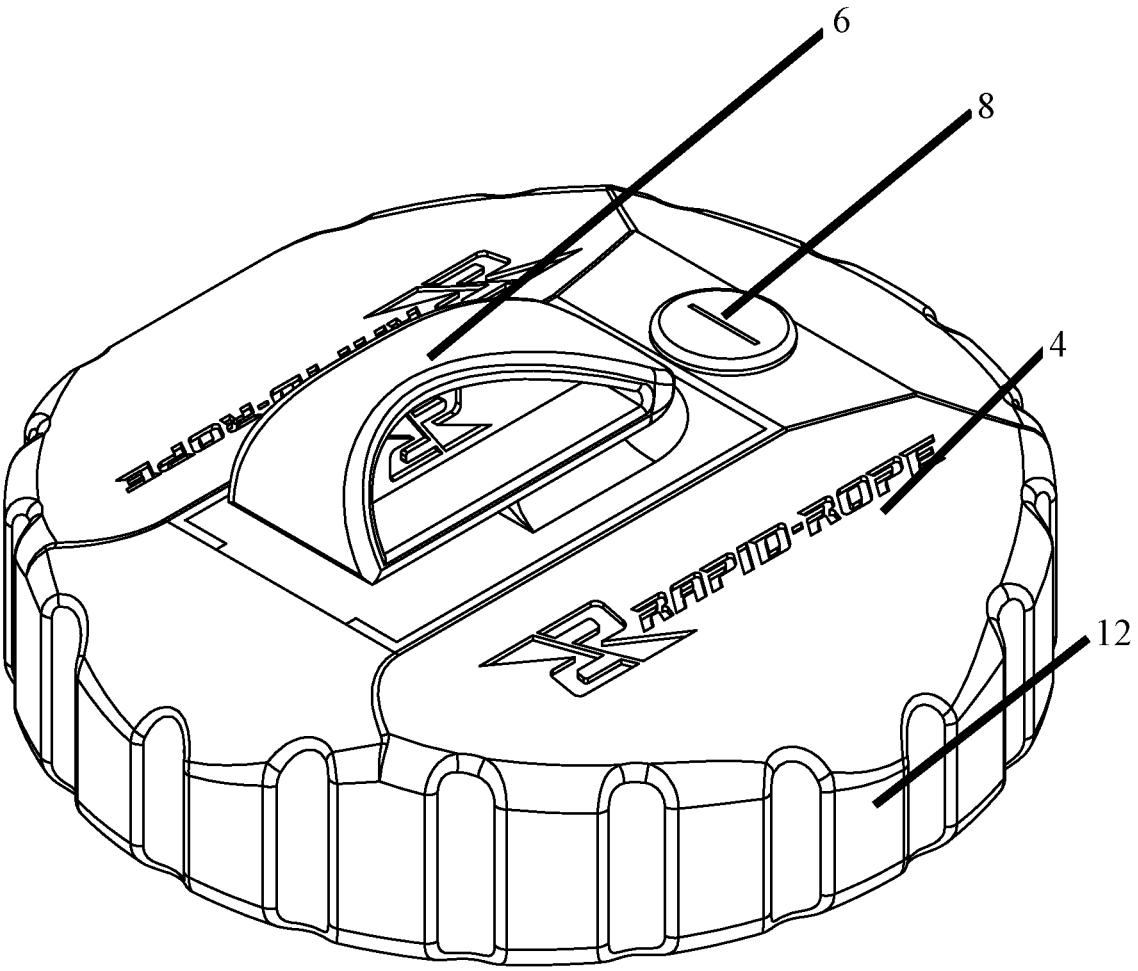
FIG. 3 is a perspective view of the lid for the disclosed Rapid-Rope system.
Figure 4:
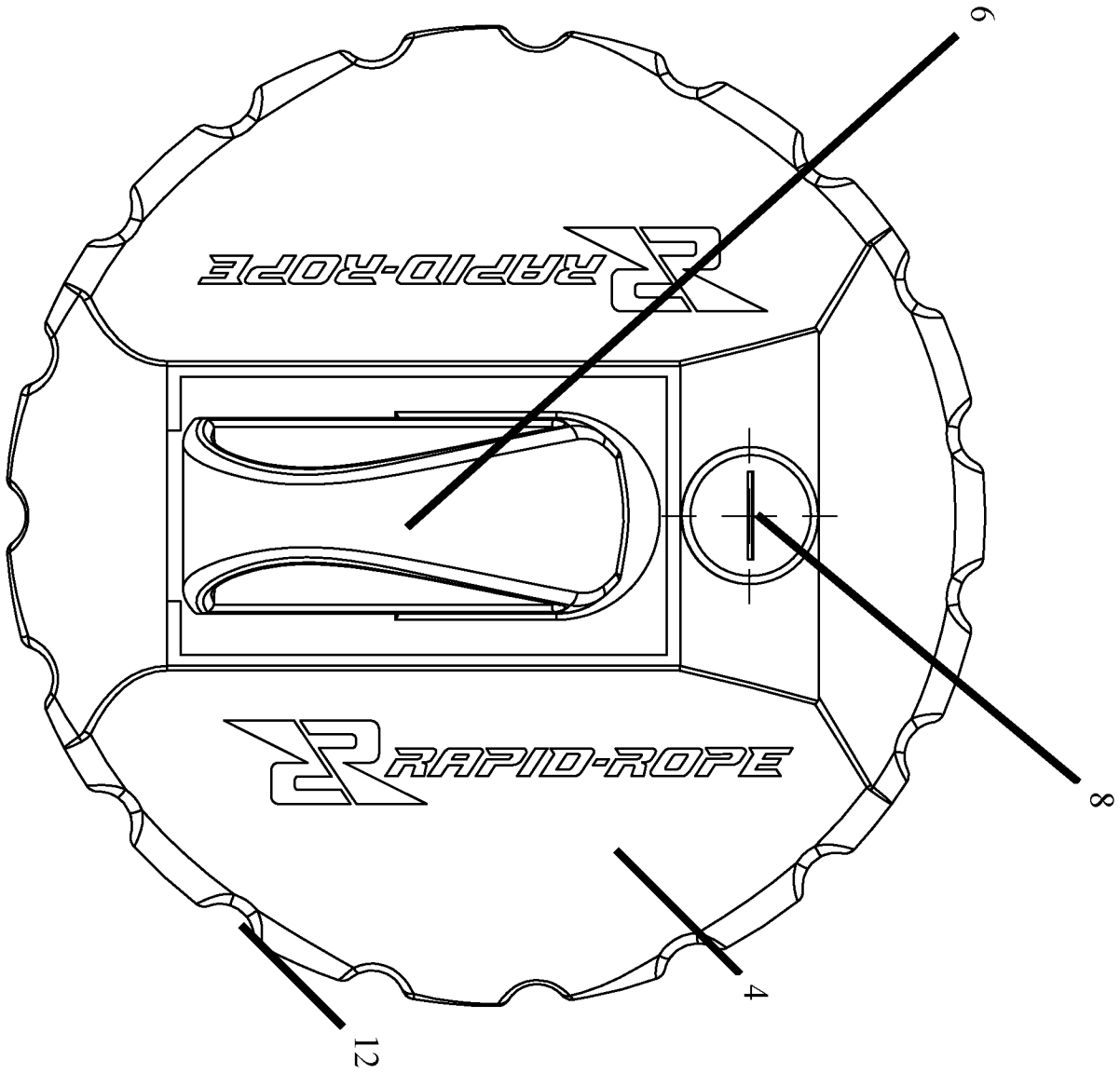
FIG. 4 is a top view of the lid for the disclosed Rapid-Rope system.
Figure 5:
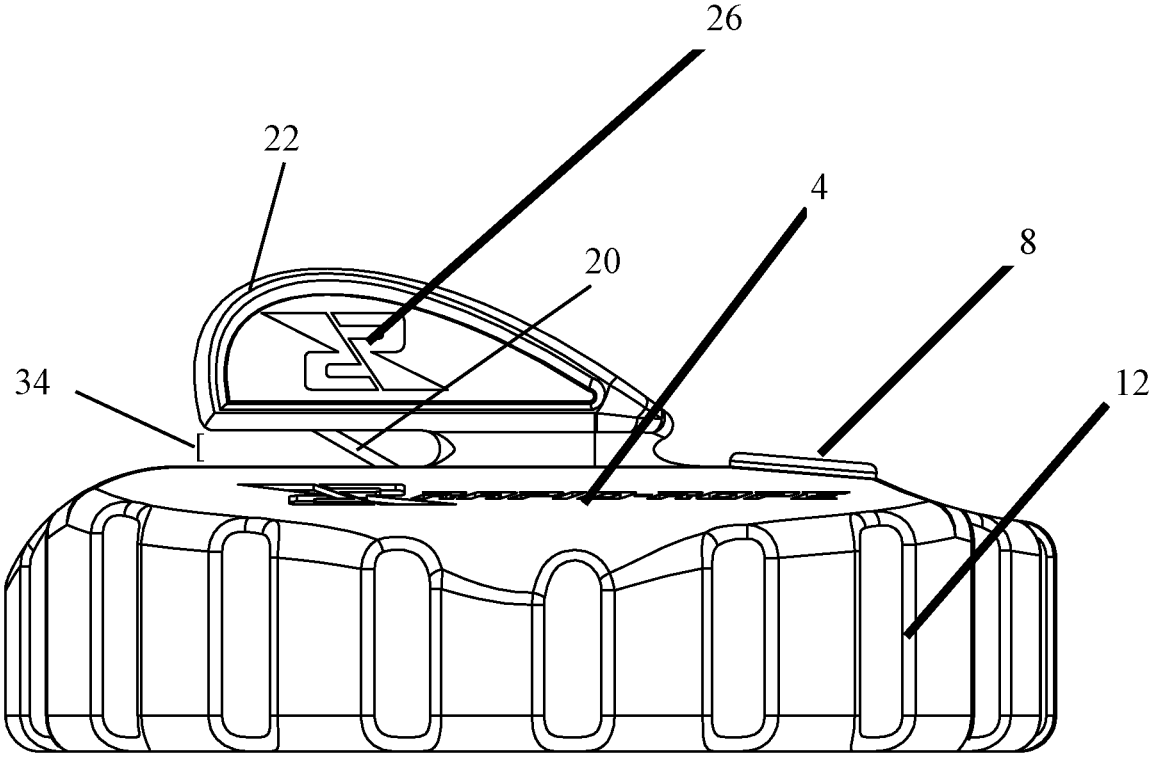
FIG. 5 is a side view of the lid for the disclosed Rapid-Rope system.
Figure 6:
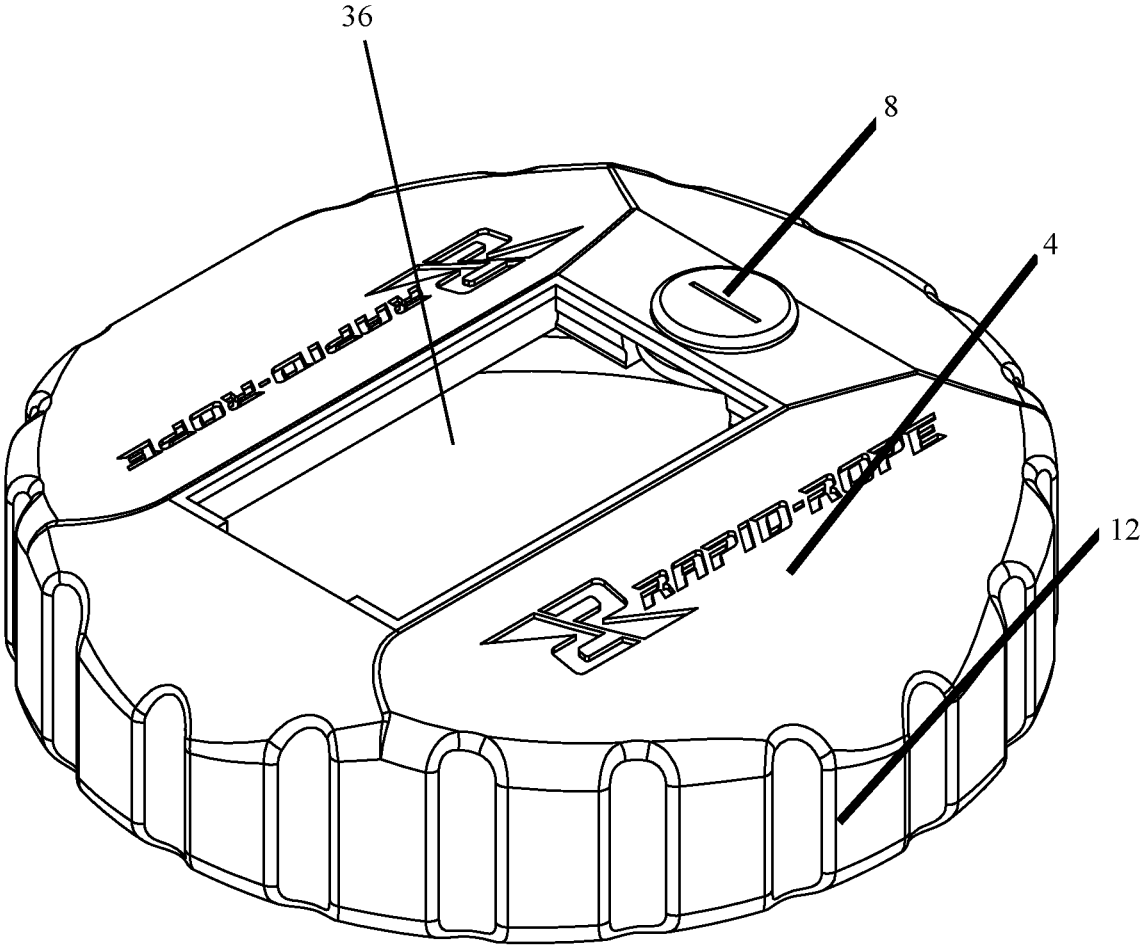
FIG. 6 is a perspective view of the lid for the disclosed Rapid-Rope system with the cutting insert removed.
Figure 7:
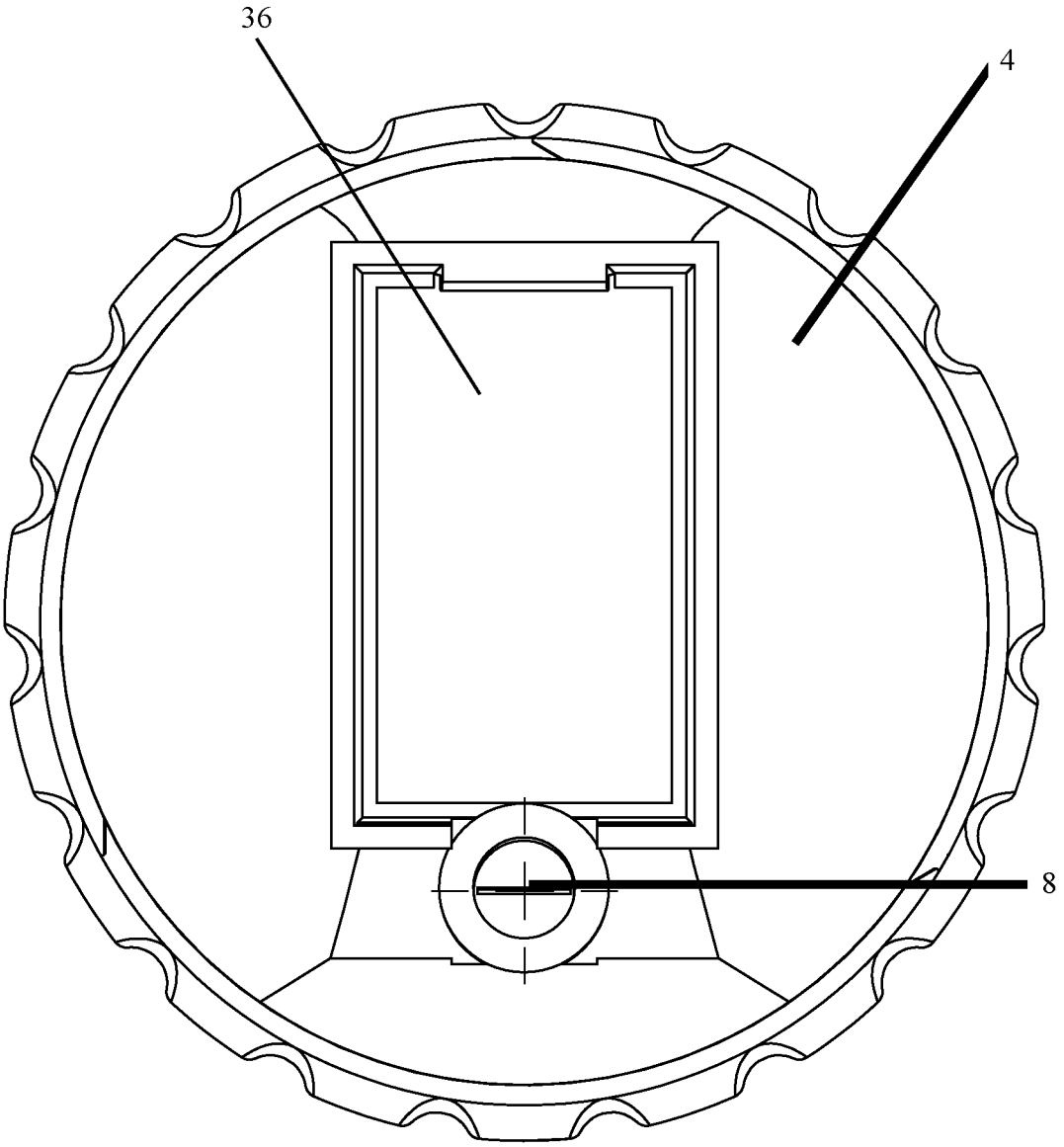
FIG. 7 is a bottom view of the lid for the disclosed Rapid-Rope system with the cutting insert removed.

The canister securely holds a cartridge of rope and fastens securely to the lid. As shown in FIG. 2, the canister 16 in a preferred embodiment is designed with straight side-walls to accept a pre-assembled cartridge of rope. The canister can be made, for example, such that cartridges of rope are replaced within the canister or such that the entire canister is disposable when the rope supply in the canister is exhausted.

In a preferred embodiment, the top of the canister has a snap fit system. Alternatively the canister could be made, for example, with hinged engagement to the lid or with threaded engagement with the lid. Any variety of attachment mechanism can be used to attach the lid to the canister.

In a preferred embodiment, the rope cartridge is wound (via precision coreless winding process) in a specified size to fit in a pre selected cartridge. The rope cartridge can be made to be replaceable within the canister such that a new rope cartridge can be placed into a canister when the prior rope cartridge is exhausted.

In a preferred embodiment, the rope material contained in the rope cartridge is produced using various types and lengths and Ultimate Tensile Strength (UTS) rope.

The rope cartridge will be packaged in shrink-wrap material to maintain the integrity of the original winding process; the rope cartridge will maintain its original form due to the shrink wrapping while in use so that it will it continue to fit securely in the cartridge until the rope is entirely dispensed.

When and if the rope cartridge is running low or is empty, the canister can be refilled with a new Rapid-Rope rope cartridge. The original and replacement rope cartridges are packaged specifically for the Rapid-Rope rope dispensing system.

The following is a description of how the rope cartridge is removed and how the Rapid-Rope rope cartridge replacement is installed:

1. Rope cartridge out (empty) or low.
2. Unsnap lid from canister and set lid aside.
3. Discard empty shrink wrap.
4. Insert new rope cartridge into canister with tail of rope standing out of the top or new rope cartridge.
5. Insert tail of rope through grommet and pull a one-inch length of rope out.
6. Place lid onto canister and snap in place.
7. Ready for use.

In a preferred embodiment, the lid assembly includes a hand grip. The hand grip is located around the circumference of the lid and is in place for the aid of easily loosening and tightening of the lid. The hand grip is contoured for easy grip of the lid by the user. The half moon shape of the lid is designed to fit into the hand of the user easily. The hand grip is designed to protect the entire lid assembly. The design of the hand grip also adds an aesthetic attribute to the lid.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims of any future filed non-provisional application.

I claim:

1. A handheld rope dispenser, comprising:
a canister defining a closed bottom end, an open top end, and an interior space;
a rope cartridge received in the interior space;
a lid releasably engaged with the open top end of the canister, the lid comprising an aperture through which rope is dispensable from the rope cartridge; and
a cutting member extending from the lid and configured to cut rope dispensed from the rope cartridge, the cutting member comprising an arm located above the aperture and above the lid, the arm extending in a side direction away from the aperture, the arm comprising a bottom facing the lid, the cutting member further comprising a blade extending from the bottom of the arm and to the lid, wherein the bottom of the arm and the lid define a slot leading to the blade
wherein the lid defines an opening extending therethrough and a hook at the opening; and
wherein the cutting member includes an edge with which the hook is engaged to retain the cutting member in the opening of the lid.

2. The handheld rope dispenser of claim 1, wherein the cutting member is releasably attached to the lid.

3. The handheld rope dispenser of claim 1 wherein the blade comprises an edge sloping downwardly at an angle from the bottom of the arm toward the lid and the aperture.

4. The handheld rope dispenser of claim 1 wherein the bottom of the arm comprises a forward end located above the lid and forming an open forward end of the slot.

5. The handheld rope dispenser of claim 1, wherein the cutting member further comprises a vertical segment extending upwardly from the lid and connecting the arm to the lid.

6. The handheld rope dispenser of claim 1, wherein:
the lid is circular in shape and comprises a diameter; and
the aperture, the arm, and the blade are aligned along the lid diameter.

7. The handheld rope dispenser of claim 1, wherein:
the rope cartridge is cylindrical in shape and comprises an outer circumference; and
the rope cartridge comprises a shrink wrapped plastic cover extending about the outer circumference of the rope.

8. The handheld rope dispenser of claim 7 wherein:
the rope cartridge comprises a top comprising a center; and
rope is dispensed from the center of the top of the rope cartridge to the aperture.

9. The handheld rope dispenser of claim 1, wherein the lid further comprises a grommet in the form of a rubber ring located in the aperture.

10. The handheld rope dispenser of claim 9, wherein the rubber ring comprises a collar.

11. The handheld rope dispenser of claim 9, wherein:
the rubber grommet comprises a hole dispensing the rope; and
the size of the hole is less than the size of the aperture.

12. A handheld rope dispenser, comprising:
a canister defining a closed end, an open end, and an interior space;
a rope cartridge receivable in the interior space;
a lid configured to releasably engage the open end of the canister, the lid defining an opening extending therethrough and an aperture through which rope is dispensable from the rope cartridge when the rope cartridge is received in the interior space, the lid is engaged with the open end of the canister, and the rope extends through the aperture from the interior space;
a cutting member receivable in the opening of the lid and releasably engageable with the opening of the lid by a snap-fit engagement mechanism, said cutting member including a blade having a cutting edge and a blade guard configured to prevent a user's finger from contacting the cutting edge when manually cutting rope dispensed through the aperture from the interior space; and
a grommet receivable in the aperture, the grommet configured to prevent rope dispensed through the aperture from retracting into the interior space of the canister;
wherein the snap-fit engagement mechanism comprises a hook at the opening of the lid and an edge on the cutting member with which the hook is releasably engageable to retain the cutting member in the opening of the lid.

13. The handheld rope dispenser of claim 12, wherein:
the hook comprises a downwardly extending stem and a head protruding outwardly from the stem; and
the head is configured to engage the edge of the cutting member to retain the cutting member in the opening of the lid.

14. A handheld rope dispenser, comprising:

a canister defining a closed bottom end, an open top end, and an interior space;

a rope cartridge received in the interior space;

a lid releasably engaged with the open top end of the canister, the lid comprising an aperture through which rope is dispensable from the rope cartridge; and a cutting member extending from the lid and configured to cut rope dispensed from the rope cartridge, the cutting member comprising an arm located above the aperture and above the lid, the arm extending in a side direction away from the aperture, the arm comprising a bottom facing the lid, the cutting member further comprising a blade extending from the bottom of the arm and to the lid, wherein the bottom of the arm and the lid define a slot leading to the blade;

wherein the lid defines an opening extending therethrough, a stem at the opening extending downwardly, and a head protruding outwardly from the stem; and wherein the cutting member includes an edge with which the head is engaged to retain the cutting member in the opening of the lid.

* * * * *